US006591753B1

(12) United States Patent
Schmid et al.

(10) Patent No.: US 6,591,753 B1
(45) Date of Patent: Jul. 15, 2003

(54) PROPELLANT DEVICE FOR PIPE WEAPONS OR BALLISTIC PROJECTION

(75) Inventors: Helmut Schmid, Karlsruhe (DE); Norbert Eisenreich, Pfinztal (DE); Gesa Langer, Walldorf (DE); Andreas Koleczko, Stutensee (DE); Rudolf Emmerich, Durmersheim (DE); Peter Elsner, Pfinztal (DE); Helfried Urban, Bretten (DE)

(73) Assignee: Fraunhofer-Gesellschaft zur Förderung der angewandten Forschung e.V., München (DE)

( * ) Notice: Subject to any disclaimer, the term of this patent is extended or adjusted under 35 U.S.C. 154(b) by 0 days.

(21) Appl. No.: 10/110,139

(22) PCT Filed: Oct. 11, 2000

(86) PCT No.: PCT/EP00/09974

§ 371 (c)(1),
(2), (4) Date: Sep. 26, 2002

(87) PCT Pub. No.: WO01/27553

PCT Pub. Date: Apr. 19, 2001

(30) Foreign Application Priority Data

Oct. 14, 1999 (DE) ..... 199 49 674

(51) Int. Cl.[7] ..... F42C 13/02; F42C 19/08; C06C 5/06

(52) U.S. Cl. ..... 102/205; 102/213; 102/275.11

(58) Field of Search ..... 102/205, 213, 102/275.11

(56) References Cited

U.S. PATENT DOCUMENTS

| | | | | | |
|---|---|---|---|---|---|
| 3,601,054 | A | | 8/1971 | Christianson | 89/28 |
| 4,765,244 | A | * | 8/1988 | Spector et al. | 102/213 |
| 6,389,974 | B1 | * | 5/2002 | Foster | 102/213 |
| 6,460,460 | B1 | * | 10/2002 | Jasper et al. | 102/213 |

FOREIGN PATENT DOCUMENTS

| | | |
|---|---|---|
| DE | 195 46 341 | 1/1997 |
| GB | 2 267 330 | 12/1993 |

* cited by examiner

*Primary Examiner*—Peter A. Nelson
(74) *Attorney, Agent, or Firm*—Paul Vincent

(57) ABSTRACT

A propellant device of consisting of a compact charge and a firing system for pipe weapons or ballistic drives is proposed. At least one electromagnetic radiation absorbing medium, e.g. carbon black, is dispersed in the compact charge and can be activated by means of a firing system emitting electromagnetic radiation. The compact charge is thereby disintergrated in fragments through triggering of the firing system and the fragments are accelerated into the gas volume produced during burning of the compact charge. The inventive propellant device avoids the use of chemical firing as well as mechanical firing means. Moreover, fragmentation of the compact charge permits maintenance of the produced maximum pressure over a longer period of time to impart a higher muzzle velocity to an object to be accelerated, e.g. a projectile, a rocket or the like.

13 Claims, 1 Drawing Sheet

PROPELLANT DEVICE FOR PIPE WEAPONS OR BALLISTIC PROJECTION

BACKGROUND OF THE INVENTION

The invention concerns a propellant device for pipe weapons or ballistic drives, consisting essentially of a compact charge and a firing system emitting electromagnetic radiation, the compact charge having an associated radiation-absorbing medium.

The power of chemically reacting propellants is substantially determined by the ratio between charge mass and its energy density to the mass of the object to be accelerated, e.g. a projectile, a rocket or the like. One always attempts to adjust the mass of the propellant and its energy density to the particular case at hand. The muzzle velocity of the projectile is determined, in particular, by the internal ballistics, i.e. the firing process, the burning of the propellant, and the transfer of energy to the projectile before it leaves the barrel.

The burning of the propellant and the acceleration of the projectile are dynamic processes which occur within an extremely short time period within which the gas development of the propellant must be adjusted to the projectile mass, while also taking into consideration the fact that acceleration of the projectile increases the volume to be filled by the propellant. These overlapping processes must be matched to ensure that the projectile reaches the desired muzzle velocity. Decisive in this case is the gas pressure-time curve, which generally resembles a Gaussian curve, i.e. the pressure increases exponentially to a maximum pressure and drops exponentially slightly less dramatically with increasing acceleration of the projectile towards the muzzle. The conversion velocity of the propellant displays similar characteristics with a more symmetric dependence of the Gaussian curve. The pressure-time integral is decisive for the driving power and has an upper limit due to the maximum admissible gas pressure in the charging chamber. A trapezoidal pressure dependence would be ideal, wherein the maximum pressure should be reached earlier while simultaneously increasing the integral of the pressure-time curve.

To achieve high muzzle velocity of the projectile, propellants of high charge density, i.e. large propellant powder mass to volume ratio, generally referred to as compact charges, are usually used. Towards this end, the high charge density required for a high muzzle velocity of the projectile is obtained by large-volume propellants with regular arrangement of the charge particles. Firing is effected via chemical firing means, e.g. nitrates which require mechanical firing means, such as striking pins or electromechanical firing means.

Disadvantageously, such firing means are sensitive to environmental influences such as heat or moisture and can cause ill-timed firing. Moreover, the vapors and gases produced by the firing means must contact as large a surface of the propellant as possible, since otherwise the linear burning speed of the propellant is too small to burn the entire charge within a short time or to obtain the pressure required for the desired muzzle velocity of the projectile. To form reproducible burning surfaces required for a reproducible pressure increase, e.g. pipe powders or cylindrical multi-hole powders are used which are penetrated by channels for passage of the firing means gases and vapors to ensure initiation of burning of the propellant over a large surface. This, however, reduces the propellant density and the muzzle speed of the projectile. Moreover, the gas pressure drops exponentially directly after the maximum. While small-caliber pipe weapons, such as air defense weapons or tank cannons achieve burning times of between 1 and 10 ms in this fashion, the burning times of large-caliber pipe weapons, such as artillery weapons, are considerably longer.

Compact charges (electro-thermal chemical cannon) are also known which can be triggered by electrical energy (DE 195 21 385 A1) with which electrical conductors are disposed in the charge. Firing and burning of such compact charges is difficult since the charge arrangement must be broken up and disintegrated, thereby producing defined surfaces to achieve firing and burning with high conversion speed of the propellant as is required for the desired muzzle velocity. The configuration of the conductors in the propellant device is also difficult to produce from a technical point of view. This is also the case for a purely inductive trigger (FR 2 159 787 C) which requires a second induction coil in the propellant charge.

The same is true for the recently examined liquid propellants which must be correspondingly dispersed.

DE 195 46 341 A1 describes a propellant with a secondary explosive disposed in a cylindrical sleeve and an initiating explosive disposed next to it which is fired through coupling of laser radiation. Such an arrangement cannot produce a high propellant conversion speed during burning since the initiating explosive is disposed only on one side of the secondary explosive facing a photoconductor and the secondary explosive is consequently not immediately broken up and decomposed when the charge is fired. This is also the case for another conventional design (GB 2 267 330 A) with which an infrared absorbing layer, on which a laser beam acts, is disposed on the rear end of propellant device.

DE 35 42 447 A1 discloses a firing mixture which can be activated by laser radiation and which contains between 10 and 30 mass % of a hot-burning metal powder of fine particles, in particular zircon, titanium or boron, 60 to 80 mass % of an oxidant, in particular lead oxide, and 1 to 5 mass % of carbon black. For firing a propellant, the firing mixture must be disposed in a narrow, defined region of the charging powder of a few $mm^2$ onto which the laser beam impinges. Immediate conversion of the charging powder is also not possible in this case. This is also true for a conventional design (U.S. Pat. No. 3,601,054 A) with which only an ignition pellet having electrical conductors, is electromagnetically triggered to thereby speed conversion.

It is the underlying purpose of the invention to propose a propellant device which optimally approaches the ideal, trapezoidal dependence of the pressure-time curve thereby avoiding the above-mentioned disadvantages during burning.

SUMMARY OF THE INVENTION

In accordance with the invention, this object is achieved by a propellant device in accordance with the independent claim in that the electromagnetic radiation has a wavelength between approximately 1 mm to about 1 m (microwaves), wherein at least one microwave absorbing medium is distributed within the compact charge which can be activated by a firing system to disintegrate the compact charge into fragments when triggering the firing system and to accelerate the fragments into the gas volume produced when burning the compact charge.

Internal firing of the inventive propellant device at the regions absorbing the microwaves disintegrates the compact charge into fragments in a defined sequence. Construction of the compact charge and arrangement of the compact charge and also of the firing system can be selected such that fragments of relatively uniform geometry can be produced which also consequently present relatively uniform surfaces to, in turn, provide uniform ignition and burning. Increased introduction of the electromagnetic radiation absorbing medium into defined regions of the propellant permits earlier firing of these regions thereby controlling the time dependence of the burning. The fragments produced during fragmentation have a large burning surface and are accelerated into the gas volume which develops during burning of the propellant and completely converted therein. This directly compensates for the volume increase and pressure drop caused by acceleration of the projectile e.g. of a pipe weapon. In a propellant device of this construction, the maximum pressure can be maintained over a longer time period such that a pressure plateau is produced in the pressure-time diagram instead of a peak, to accelerate the projectile with a gas pressure of longer persistence. This permits reduction of the maximum pressure and muzzle pressure without reducing the drive power or muzzle velocity. Alternatively, the muzzle velocity can be considerably higher for a given maximum pressure.

The inventive propellant device avoids chemical firing means which makes its handling simpler and safer. Moreover, it avoids use of mechanical or electromechanical firing means required for initiating such chemical firing means and is therefore inexpensive due to its simple construction.

The density of the inventive propellant device can be considerably increased compared to conventional propellants by embedding the medium absorbing the microwaves in thin layers such that it requires considerably less space compared to the channels for the passage of vapors and gases used in conventional propellants.

The substantially uniform, structured design of the compact charge and the uniform insertion of the medium absorbing the microwaves permits the formation of fragments having a relatively uniform geometry and consequently large burning surfaces. When the firing system is triggered, the compact charge is broken up along the regions of the microwaves radiation absorbing medium and accelerated inwardly in correspondingly uniform fragments, wherein the surfaces which are formed facilitate clean firing and burning.

The compact charge can be interspersed with e.g. layers of the medium absorbing electromagnetic radiation, which are disposed in a substantially uniform geometrical design, wherein the layers are preferably substantially disposed in a grid-like manner. Depending on the type of the explosive and the medium absorbing microwave radiation, the layer thickness is thereby advantageously between 1 and 1000 $\mu$m.

The compact charge can be interspersed by channels of the medium absorbing the microwave radiation which are disposed in a substantially geometric arrangement, wherein the diameter of the channels is advantageously between 1 and 1000 $\mu$m.

A substantially dispersed arrangement of the microwave radiation absorbing medium in the compact charge is also feasible, wherein the dispersions can be disposed in a random or substantially uniform geometrical arrangement, preferably a grid.

In any event, the microwave absorbing medium which is dispersed in the explosive and which optionally surrounds the explosive can initiate firing of the compact charge or fragmentation thereof in any fashion, e.g. by heating with optional associated thermal expansion and/or evaporation, photo reaction, splitting, conversion into a plasma state or the like. The compact charge can either be substantially powdery with the powder particles being arranged as described above, or the compact charge can be a unit which can be introduced e.g. into a charging chamber of a pipe weapon.

A further development of the invention provides that the intensity of the microwave radiation of the firing system can be controlled. Temporal or local control of the microwave radiation permits precise control of the pressure-time dependence, e.g. through precise delayed firing of the produced fragments or by heating the combustion gases by adjusting the microwave radiation to the resonance frequency thereof. For example, pulsed coupling of the microwave radiation with optionally changing frequency until the projectile exits through the muzzle of the pipe weapon is feasible. Moreover, the electromagnetic radiation used for firing the compact charge can be adjusted to the surrounding conditions such that e.g. with increased surrounding temperature and associated increased burning velocity, the intensity of radiation can be reduced to activate only part of the deposits of microwave absorbing medium for reducing fragmentation of the compact charge and the burning surface to thereby compensate for the temperature-dependent increase in the burning speed.

The microwave radiation can be coupled into the compact charge e.g. by means of an emitter extending into the compact charge, e.g. an antenna. Alternatively, it can be coupled into the compact charge by means of emitters surrounding the compact charge. In any event, the compact charge can be disposed in a cartridge. This is particularly advantageous for handling a substantially powdery propellant.

The microwave radiation absorbing medium is preferably carbon, in particular carbon black, due to its compatibility with most explosives and due to its high absorption capacity for this radiation through a broad frequency range.

The invention is described in more detail below with reference to the drawings.

DESCRIPTION OF THE PREFERRED EMBODIMENT

Figure 1:
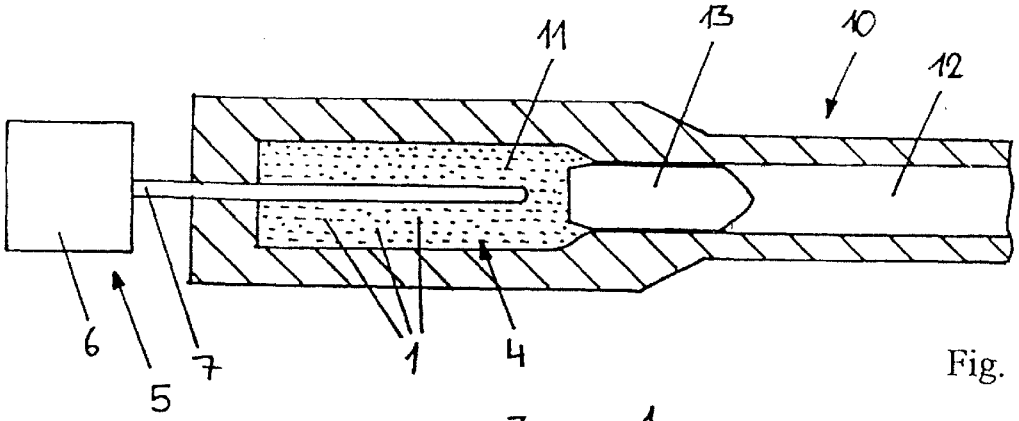
FIG. 1 shows a cross-section through an inventive propellant device for pipe weapons.
Figure 2:
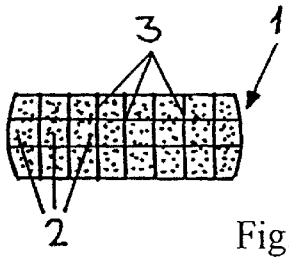
FIG. 2 shows a schematic view of the granular arrangement of the inventive propellant.

FIG. 1 shows a schematic cross-section through a pipe weapon 10 with a barrel 12 (broken off in the drawing) and a charge chamber 11 which houses a propellant 4 in the form of a compact charge. The compact charge 4 consists e.g. of a powder and an explosive or an explosive mixture and a distributed microwave radiation absorbing medium, e.g. carbon black. FIG. 2 shows that the absorbing medium 3 is uniformly distributed in the propellant particles 1 of the compact charge thereby penetrating through the explosive 2 in grid-like layers. A projectile 13 is disposed in the barrel 12 whose rear projects into the charge room 11. A firing system 5 including a controllable microwave generator 6 is provided for firing the propellant 4. The electromagnetic radiation produced by the microwave generator 6 can be coupled into the charge room 11 via an antenna 7.

After firing of the compact charge 4 by the microwave generator 6, the particles 1 of the compact charge 4 are disintegrated along the carbon black layers 3 into substantially uniform fragments and the fragments are accelerated into the gas volume produced during burning of the compact charge 4. At the same time the fragments are burned and the propellant fragments from the compact charge 4 are converted. The projectile 13 is uniformly loaded with an approximately constant pressure through a longer distance and leaves the barrel 12 at the desired muzzle velocity with optionally reduced muzzle pressure.

Figure 3:
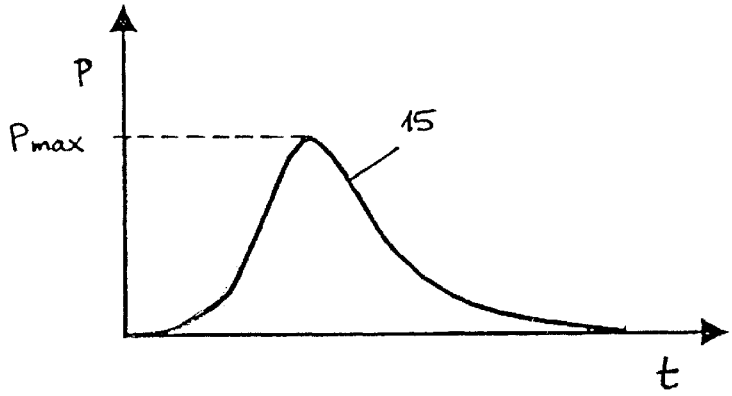
FIG. 3 shows a pressure-time diagram of a conventional propellant with chemical firing means.

FIG. 3 shows the curve 15 of the pressure-time-dependence of a conventional propellant. The pressure p rises exponentially to a maximum pressure $P_{max}$ and drops less steeply and exponentially with increasing acceleration of the projectile towards the barrel muzzle.

Figure 4:
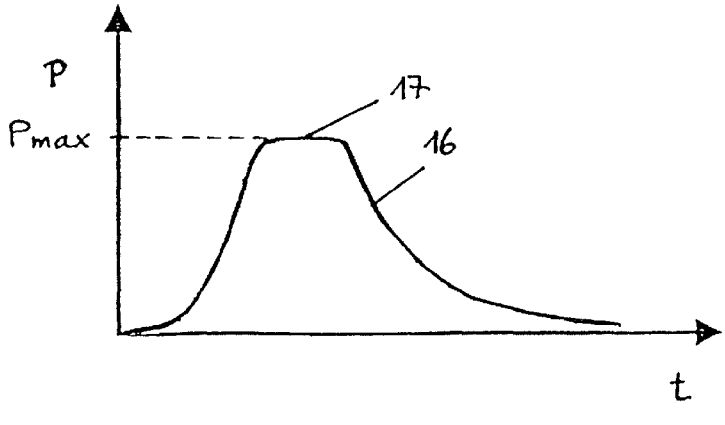
FIG. 4 shows a pressure-time diagram of an inventive propellant device.

FIG. 4 shows that the inventive propellant device can produce a pressure dependence according to curve 16 which shows a distinct pressure plateau 17 with delayed pressure drop and slightly advanced rise. This permits reduction of the maximum pressure $P_{max}$ with increased drive power as determined by the pressure-time integral. Alternatively, the drive power can be increased for a given maximum pressure.

We claim:

1. A propellant device for pipe weapons or ballistic drives, the device comprising:

a compact charge;

an associated firing system for said compact charge, said firing system emitting microwave radiation having a wavelength between approximately 1 mm to approximately 1 m; and at least one microwave radiation absorbing medium distributed within said compact charge for activation by said firing system to disintegrate said compact charge into fragments when triggering said firing system for accelerating said fragments into a gas volume generated during burning of said compact charge.

2. The propellant device of claim 1, wherein said medium which absorbs microwave radiation is regularly distributed in said compact charge.

3. The propellant device of claim 1, wherein said compact charge is penetrated by layers of said microwave radiation absorbing medium which are disposed in a substantially geometrical, uniform fashion.

4. The propellant device of claim 3, wherein said layers are disposed substantially like a grid.

5. The propellant device of claim 3, wherein said layers have a thickness between 1 and 1000 $\mu$m.

6. The propellant device of claim 6, wherein said compact charge is penetrated by channels of said microwave radiation absorbing medium, said channels being disposed in a substantially uniform, geometric arrangement.

7. The propellant device of claim 6, where said channels have a diameter between 1 and 1000 $\mu$m.

8. The propellant device of claim 1, wherein said microwave radiation absorbing medium is substantially dispersed in said compact charge.

9. The propellant device of claim 1, wherein an intensity of said microwave radiation of said firing system can be controlled.

10. The propellant device of claim 1, wherein said microwave radiation can be coupled into said compact charge by means of an emitter extending into said compact charge.

11. The propellant device of claim 1, wherein said electromagnetic radiation can be coupled into said compact charge by means of at least one emitter surrounding said compact charge.

12. The propellant device of claim 1, wherein said compact charge is disposed in a cartridge.

13. The propellant device of claim 1, wherein said microwave radiation absorbing medium is carbon or carbon black.

* * * * *